United States Patent [19]

Dürst

[11] Patent Number: 4,691,764

[45] Date of Patent: Sep. 8, 1987

[54] HEAT EXCHANGER UNIT WITH SUPPORT RING AND RADIAL BRACKETS

[75] Inventor: Felix Dürst, Zürich, Switzerland

[73] Assignee: Norbert Allenspach, Switzerland

[21] Appl. No.: 839,357

[22] Filed: Mar. 13, 1986

[30] Foreign Application Priority Data

Mar. 15, 1985 [CH] Switzerland ..... 1167/85

[51] Int. Cl.[4] ..... F28F 9/00

[52] U.S. Cl. ..... 165/68; 165/165; 165/900; 165/67

[58] Field of Search ..... 165/165, 901, 905, 67, 165/900, 125, 68

[56] References Cited

U.S. PATENT DOCUMENTS

| | | | |
|---|---|---|---|
| 2,383,292 | 8/1945 | Dalzell et al. | 165/68 |
| 3,367,413 | 2/1968 | Forster | 165/900 X |
| 3,519,068 | 7/1970 | Harris et al. | 165/68 |

FOREIGN PATENT DOCUMENTS

| | | | |
|---|---|---|---|
| 2530611 | 1/1977 | Fed. Rep. of Germany | 165/67 |
| 2811301 | 10/1979 | Fed. Rep. of Germany | 165/DIG. 1 |
| 0150247 | 8/1981 | Fed. Rep. of Germany | 165/67 |
| 2300983 | 10/1976 | France | 165/DIG. 1 |

*Primary Examiner*—Albert W. Davis, Jr.
*Assistant Examiner*—Randolph A. Smith
*Attorney, Agent, or Firm*—McGlew and Tuttle

[57] ABSTRACT

A heat exchanger unit comprises a support on which is positioned a plurality of stays mounted at spaced locations. A horizontally extending bracket is secured to each of the stays and a plurality of connected heat exchanger plates are suspended from their upper ends from the brackets. The plates have heat media carrying channels which are joined together. The support advantageously comprises a steel ring to which the brackets are attached and which extend radially inwardly also radially outwardly. The heat exchanger plates are rectangularly shaped and are suspended from each bracket so that it hangs freely downwardly. Wire guards extend between the plates to prevent them from deflecting and contacting each other. The construction permits the elimination of spaced support elements which interfere with free heat exchange flow between the plates.

5 Claims, 5 Drawing Figures

HEAT EXCHANGER UNIT WITH SUPPORT RING AND RADIAL BRACKETS

FIELD AND BACKGROUND OF THE INVENTION

The invention relates in general to heat exchangers and in particular to a new and useful heat exchange unit that has heat exchange plates that are mounted on a support at intervals from one another and have heat carrying channels that connect with one another.

Heat exchange systems of this kind are known in which the heat exchanger plates lie at intervals one on top of the other and thus create a vertical stack. To achieve the greatest possible heat release or absorption, plates, preferably of plastic, with a relatively large surface area, but thin and containing many narrow heat carrying channels must be used. A properly functioning stack of such heat exchanger plates is usually heavy, since, particularly under icing conditions, too great a sagging of the plates under their own weight must be prevented or rendered harmless, which means either leaving large intervals between the plates with correspondingly less efficient use of space or providing relatively complicated supporting structures between the plates.

SUMMARY OF THE INVENTION

The present invention provides a heat exchanger unit in which a large number of heat exchanger plates with relatively large surface areas, and hence not very stable in shape, can be fitted into a relatively small area, and in which maintaining the requisite plate intervals for unhampered flow-through channels can be achieved by simple means.

A heat exchanger unit pursuant to the invention includes heat exchanger plates suspended by the upper edge of the plate so that they hang down freely from horizontal brackets attached at one end to the stays positioned on a support.

One embodiment has been found to be particularly advantageous, in which the support has a horizontal ring attached to vertical stays, to which ring a first set of brackets extending radially inwards at equal intervals along the circumference is attached, with a length shorter than the radius of the ring. A second set of brackets of the same length is attached extending radially outwards and staggered with the brackets of the first set, with a rectangular-shaped heat exchanger plate fastened at its upper narrow side to each bracket so that it hangs down freely.

Suspending the heat exchanger plates, which are usually relatively thin and hence usually have little shape stability, on horizontal brackets means that a large number of heat exchanger plates can be attached in relatively large units without the need for relatively complicated clamping frames and elements directly supporting the adjacent plates.

Accordingly it is an object of the invention to provide an improved heat exchanger which comprises a support such as a steel ring with a plurality of stays mounted on the support at spaced locations with a horizontal bracket connected to the stays on which a plurality of heat exchanger plates are suspended from their upper end.

A further object of the invention is to provide a heat exchanger which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
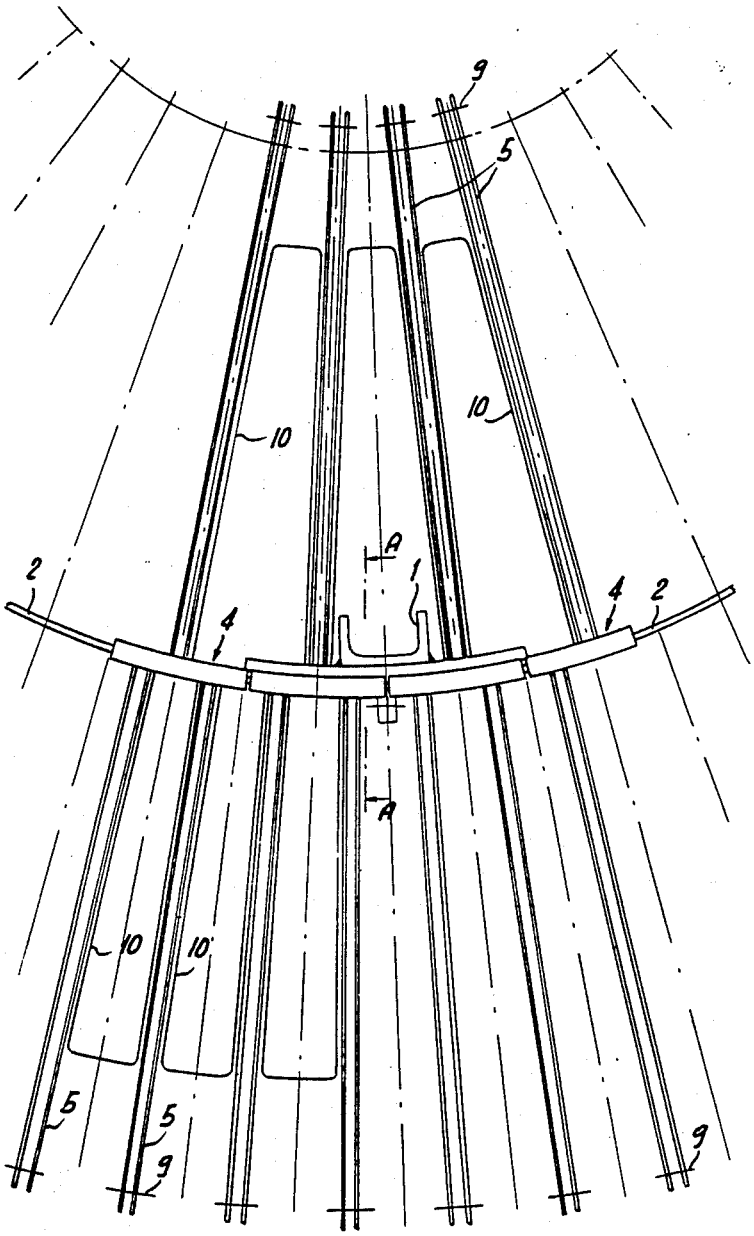
FIG. 1 is a schematic top view of a section of a tower unit pursuant to the invention.

Referring to the drawings in particular the invention embodied therein comprises a heat exchanger which includes a support which is a steel ring with a plurality of stays 1 mounted on the ring at spaced locations. A horizontal bracket 5 is secured to each stay and a plurality of interconnected plates 6 are suspended from the bracket and each includes a heat media carrying channel with the channels joined together.

Figure 2:
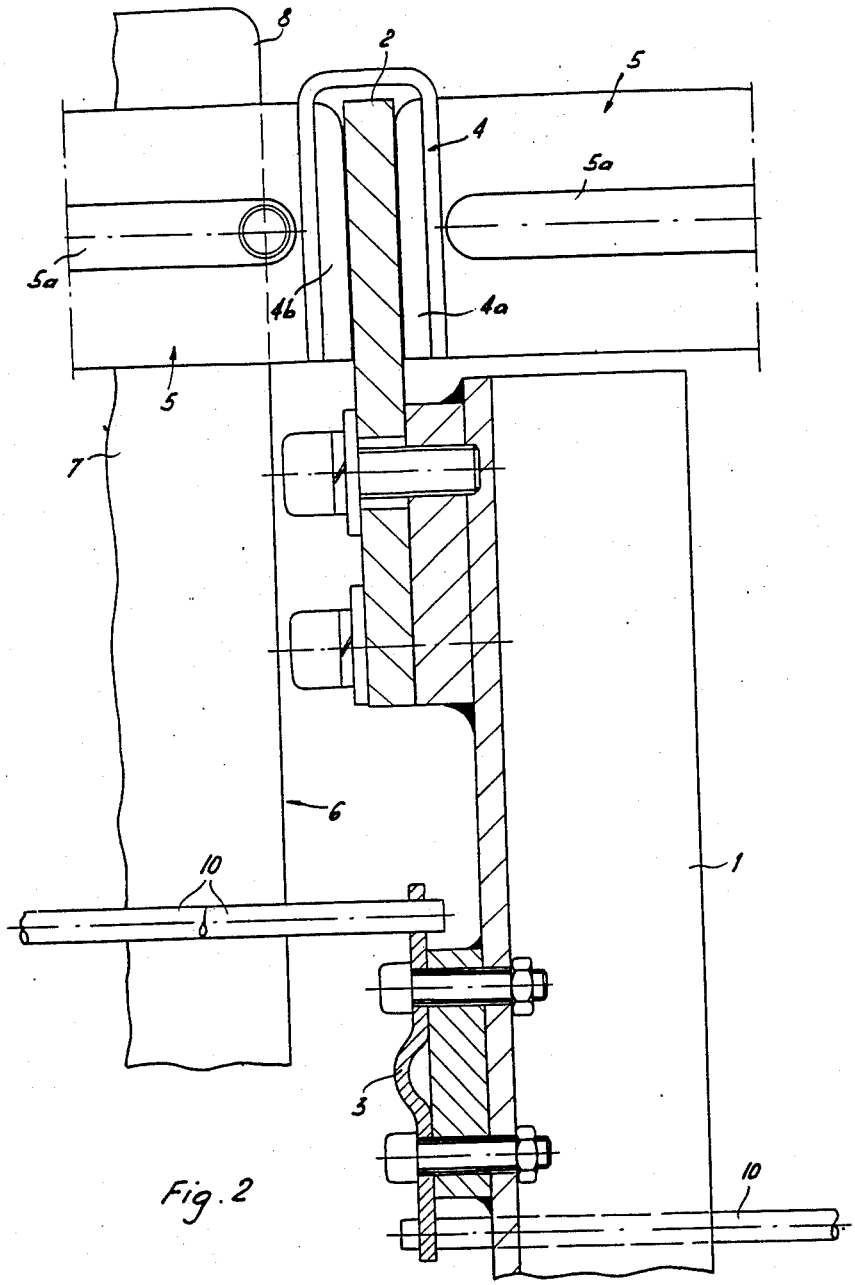
FIG. 2 is a vertical section on a larger scale taken along the line A—A of FIG. 1 through the upper portion of the tower.
Figure 4:
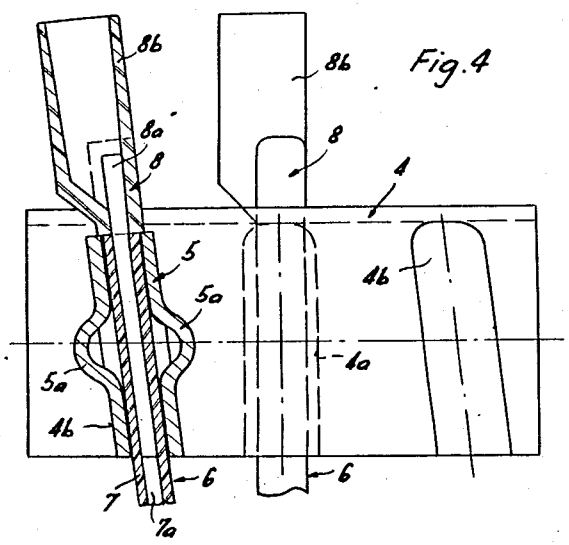
FIG. 4 is a frontal elevational view of FIG. 3 with an outer bracket and a heat exchanger plate suspended therefrom, shown in cross-section.
Figure 3:
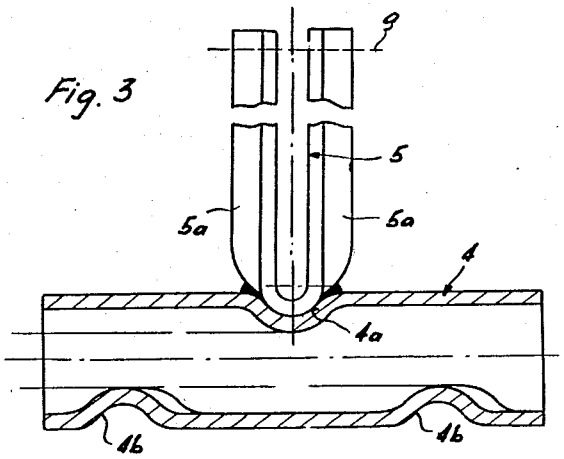
FIG. 3 is a horizontal section of a bracket holder with an inner bracket in place.
Figure 5:
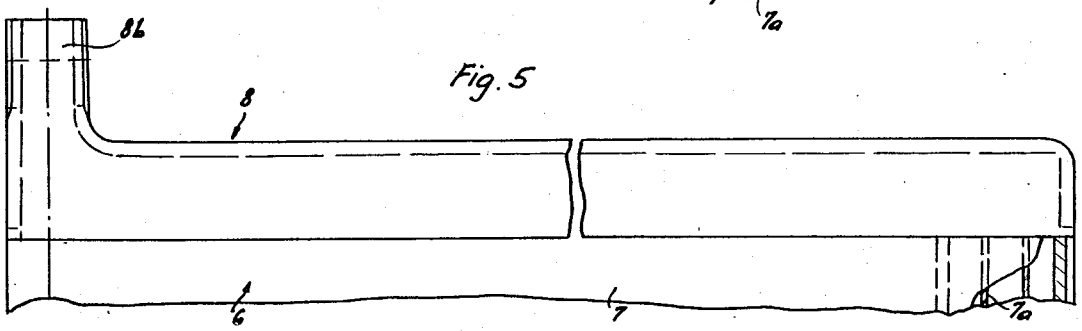
FIG. 5 is a side elevational view of one part of the edge of the heat exchanger plate in FIG. 4.

The tower-like heat exchanger unit shown has a number (four, for example) of U-section stays 1 arranged in a circle, whose upper ends are joined together by a horizontal flat steel ring 2. At about half the height of the stay, for example, another horizontal steel ring 3 (FIG. 2) is attached to the stays. This creates a stable cylindrical tower framework. On the steel ring 2 are seated U-section pieces 4, whose vertical sides have crimps 4*a*, 4*b* lying with their bases inside against the steel ring 2. Every U-section piece 4 has on the radially inner side a crimp 4*a* centrally positioned, vertical, semi-cylindrical in cross-section, and on the radially outer side two similar crimps 4*b* displaced sideways with respect to crimp 4*a* and inclined by a few degrees, between 5° and 15°, for instance, and preferably 6°, from the vertical to the same side. The arrangement of the U-section pieces 4 and the steel ring 2 and the spacings between the two crimps 4*b* are so chosen that the number of the crimps facing radially inwards with respect to the axis of the tower and placed at equal intervals is half as large as the number of the crimps 4*b*, also placed at equal intervals but facing radially outwards. In each of these crimps 4*a*, 4*b* sits the base correspondingly rounded in cross-section at the closed end of a hair-pin bracket 5. These brackets 5, firmly welded to the U-section piece 4 either vertically or at a slight incline, depending on the angle of the crimps, have on each of their two flat sides running parallel to one another a central reinforcing crimp 5*a* running longitudinally with the convex side outward. Since the brackets 5 are attached in groups on individual section pieces 4 and not directly onto the steel ring 2. Storage, transportation and assembly of the individual parts of the tower unit are rendered considerably easier. Between the two sides of each bracket 5 is introduced the upper narrow edge of a rectangular-shaped heat exchanger plate 6, the length of which is a multiple of its width. The heat exchanger plates 6 are, themselves known from Swiss Patent No. G 5323/83 and now U.S. Pat. No. 4,625,794, for example and are preferably made of a plastic material and have a plate element 7 with a large number of channels 7*a* running longitudinally (FIG. 5) and ending at the narrow sides of the plate element in a distribution or collection channel 8*a* built into blunt welded channel piece 8 that appears U-shaped in cross section; the channel pieces 8 are equipped at one of the long ends with a terminal piece 8*b*. The channel pieces 8 have a somewhat greater wall thickness than the plate elements 7, so that, at the transition of the two plate parts 7, 8, a narrow shoulder is created, with which the heat exchanger plates 6, the thickness of whose plate element corresponds to the interval between the sides of the bracket, press against the upper short end of that bracket side. As shown at 9 in FIGS. 1 and 3, the free ends of the sides of the bracket 5 are joined together by a screw, thus preventing any undesired spreading of the bracket sides and making it possible to grip the heat exchanger plate 6 firmly in the bracket 5 by applying light pressure. Naturally, the radial length of the brackets 5 (all of which are the same length) is considerably smaller than the radius of the steel ring 2, and the space between the radially inner brackets 5 is chosen so that their radially inner ends and hence the radially inner longitudinal edges of the heat exchanger plates 6 suspended from them as well still have enough space between them not to touch the edges being shorter than the bracket lengths.

Thanks to the cylindrical tower design of the unit with the heat exchanger plates 6 suspended and hanging down freely from the radial brackets 5, a compact heat exchange unit is created that can be mounted outdoors and that at small construction cost makes it possible to incorporate an extremely large total heat exchange surface in relation to the volume of the tower. The heat exchange surface is accessible to the air that serves as an external heat carrying medium not only from below, above and radially outwards, but thanks to the radially inner plate-free space of the tower from the inside as well. Thanks to the slight inclination of the radially outer heat exchanger plates 6, it comes about that the layers of air between the radially outer plates are slightly inclined with respect to the air layers of the radially inner plates, which, when air flows through radially, leads to a correspondingly separating and mixing of the various air currents at the transition from one set of plates arranged in a ring to the other. The heat absorption, or release between the air and the heat carrying medium circulating inside the plates, can thus be improved substantially. Although in the illustrated embodiment the heat exchanger plates 6 positioned on the inside radially speaking are suspended so that they hang down vertically, these plates could also be inclined from the vertical, either in the same direction as the radially outer plates or in the opposite direction. In order to prevent the inclined plates 6 from bending towards the vertical, securing wires can be provided from the brackets 5 leading from the top down, to secure the slanting position of the plates from the top down.

With relatively long (e.g. 3 to 6 m) heat exchanger plates 6, which are usually only 40 to 50 cm wide, it may be necessary to provide a means whereby the free-hanging plates are prevented, under the influence of the wind, for instance, from approaching one another too closely or even touching at their lower edges. For this purpose, in the illustrated embodiment, steel wire guards 10 projecting radially between the plates 6 are attached to the lower steel ring 3 (there may also be two additional such steel rings 3 placed at vertical intervals to one another on the stays 1). The width of these horizontal guards 10 is so chosen that they practically touch the correctly hanging plates 6 and thus fix their interval from one another, so that deflection of the plates, under the influence of the wind, for example, is prevented and the plates are perfectly secured against touching one another. On the other hand, the guards 10 made, for example from relative thin steel wire, cannot noticeably impede the passage of the air between the plates.

In addition to the steel wire guards 10 that maintain the interval between the plates, U-sections may be attached to a steel ring mounted on the stays 1 in the area of the lower narrow side of the free-hanging heat exchanger plates 6 and positioned so that they are staggered sideways with respect to the corresponding bracket 5 and either in a vertical line or inclined to correspond with the inclination of the radially outer plates, in which U-sections the lower channel pieces 8 of the heat exchanger plates 6 are secured both against sideways deflections and against falling down. In such case, the steel wire guards 10 prevent any undesirable curving of the plates.

Although the described tower-like design for the unit with two sets of heat exchanger plates 6, one radially inner, one radially outer, suspended on a single upper steel ring 2 has proven to be especially suitable, it would be possible to set up only a single set of heat exchanger plates 6, either radially inside or radially outside. If heat exchanger plates of smaller lengths (e.g., from 1.5 to 3 m) are used, it is also possible to set up two steel rings, each equipped with brackets, at corresponding vertical intervals one above another on the stays 1.

Although the cylindrical tower design is particularly advantageous, because of its independence of the direction of air currents at any given time, the tower structure may also have a rectangular shape. Thus, for example, a rectilinear support could be provided that joins the upper ends of two stays, to which support one set of horizontal brackets parallel to one another is attached on each side, with one set of staggered, for example, with respect to one another, on which the heat exchanger plates are suspended by their upper narrow edge.

The construction and mounting of the heat exchange unit pursuant to the invention which can naturally be used both to warm and to cool the heat-carrying medium circulating inside the plates, are easy, and the construction cost of securely setting and fixing the intervals between the heat exchanger plates is considerably lower than for prior art units of this kind.

While specific embodiments of the inveniton have been shown and described in detail to illustrate the application of the principles of the invention, it will be understood that the invention may be embodied otherwise without departing from such principles.

What is claimed is:

1. A heat exchanger, comprising a support, a plurality of stays mounted at spaced locations on said support, a horizontal bracket secured to each of said stays, a plurality of connected heat exchanger plates having at least one plate with an upper end suspended from said bracket, said plates having heat media carrying channels which are joined together, said brackets project out at intervals from one another from at least one side of said support and lying in a horizontal plane, said heat exchanger comprises a cylindrical tower structure, said support comprising a cylindrical steel ring having a radius, said brackets projecting radially outwardly and inwardly at regular intervals from one another, each of said brackets having a radial length and each of said heat exchanger plates having a radial edge extending along the bracket to which it is connected, the lengths being longer than the edges but shorter than the radius of said steel ring forming said support.

2. A heat exchanger according to claim 1, wherein said brackets are open loops and are attached in clusters and include bases with section pieces that are fastened to said support, said heat exchanger plates being firmly clamped between the sides of said brackets.

3. A heat exchanger unit according to claim 2, wherein at least the heat exchanger plates are suspended from said brackets and project from one side of said support and are attached at an angle of from 5° to 15° away from the vertical in respect to said sectional pieces.

4. A heat exchanger, comprising a support, a plurality of stays mounted at spaced locations on said support, a horizontal bracket secured to each of said stays, a plurality of connected heat exchanger plates having at least one plate with an upper end suspended from said bracket, said plates having heat media carrying channels which are joined together, and wire guard interval maintainers supported by said stays and projecting in the spaces between said heat exchanger plates and encompassing said plates, said brackets having horizontal U-shaped sections supported by said stays and said wire guard interval maintainers embracing the lower portion of said heat exchanger plates in order to secure said plates against sideways movement.

5. A heat exchanger unit according to claim 4, including securing wires extending down a side of at least one of said plates and connected to one of said brackets for preventing deflections of the one heat exchanger plate.

* * * * *